US005208860A

United States Patent [19]

Lowe et al.

[11] Patent Number: 5,208,860

[45] Date of Patent: May 4, 1993

[54] SOUND IMAGING METHOD AND APPARATUS

[75] Inventors: Danny D. Lowe; John W. Lees, both of Calgary, Canada

[73] Assignee: QSound Ltd., Calgary, Canada

[21] Appl. No.: 786,027

[22] Filed: Oct. 31, 1991

Related U.S. Application Data

[60] Division of Ser. No. 696,989, May 2, 1991, Pat. No. 5,105,462, which is a continuation of Ser. No. 398,988, Aug. 28, 1989, abandoned, which is a continuation-in-part of Ser. No. 239,981, Sep. 2, 1988, Pat. No. 5,046,097.

[51] Int. Cl.[5] ..... H04S 5/00

[52] U.S. Cl. ..... 381/17

[58] Field of Search ..... 381/17, 97, 1

[56] References Cited

U.S. PATENT DOCUMENTS

| | | | |
|---|---|---|---|
| 4,706,287 | 11/1987 | Blackmer et al. | 381/63 |
| 4,792,974 | 12/1988 | Chace | 381/17 |
| 4,817,149 | 3/1989 | Myers | 381/1 |
| 4,817,162 | 3/1989 | Kihara | 381/17 |

*Primary Examiner*—Forester W. Isen

*Attorney, Agent, or Firm*—Lewis H. Eslinger; Jay H. Maioli

[57] ABSTRACT

The illusion of distinct sound sources distributed throughout the three-dimensional space containing the listener is possible using only conventional stereo playback equipment by processing monaural sound signals prior to playback on two spaced-apart transducers. A plurality of such processed signals corresponding to different sound source positions may be mixed using conventional techniques without disturbing the positions of the individual images. Although two loudspeakers are required the sound produced is not conventional stereo, however, each channel of a left/right stereo signal can be separately processed according to the invention and then combined for playback. The sound processing involves dividing each monaural or single channel signal into two signals and then adjusting the differential phase and amplitude of the two channel signals on a frequency dependent basis in accordance with an empirically derived transfer function that has a specific phase and amplitude adjustment for each predetermined frequency interval over the audio spectrum. Each transfer function is empirically derived to relate to a different sound source location and by providing a number of different transfer functions and selecting them accordingly the sound source can be made to appear to move.

6 Claims, 16 Drawing Sheets

Image Location
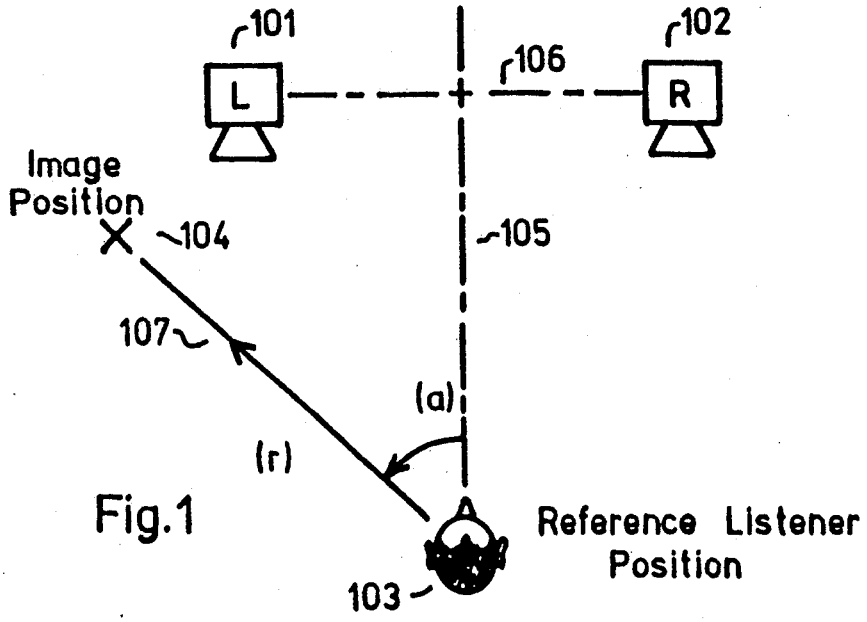
Fig.1
Fig. 2
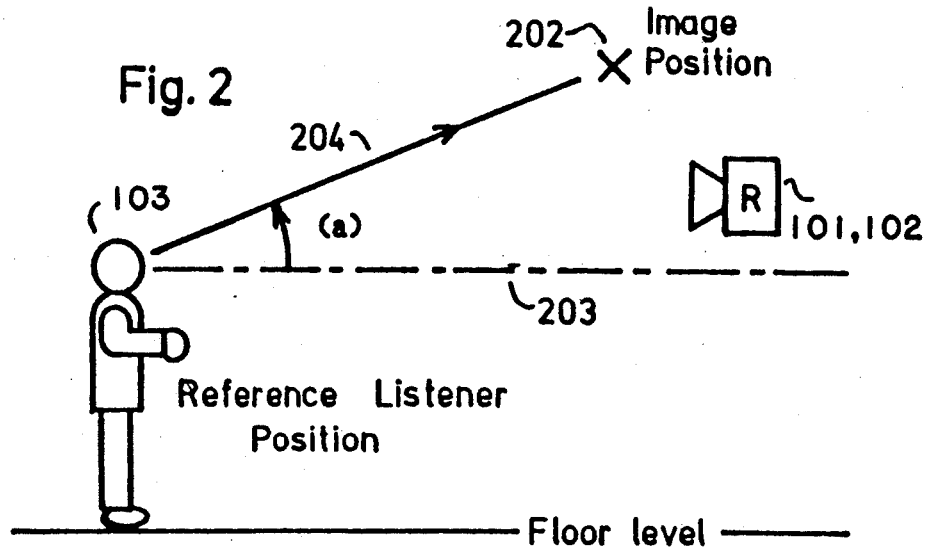

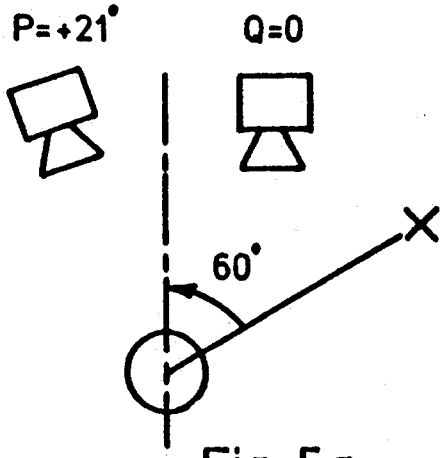
Fig. 5g
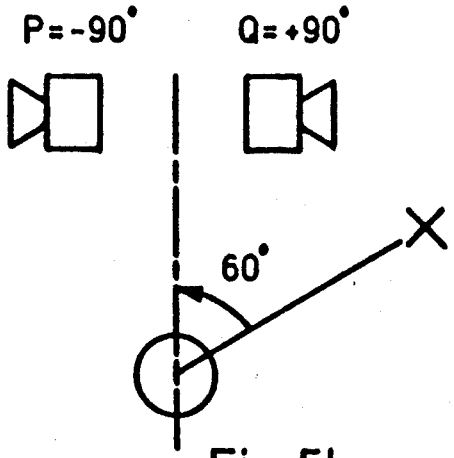
Fig. 5h
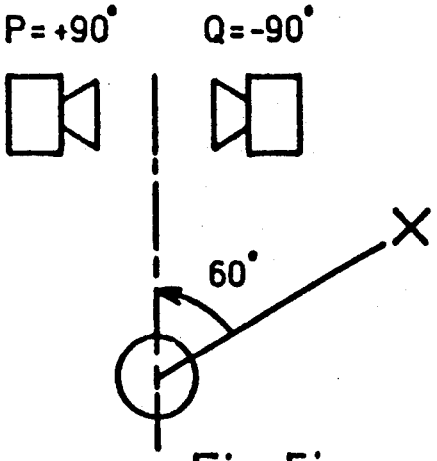
Fig. 5j
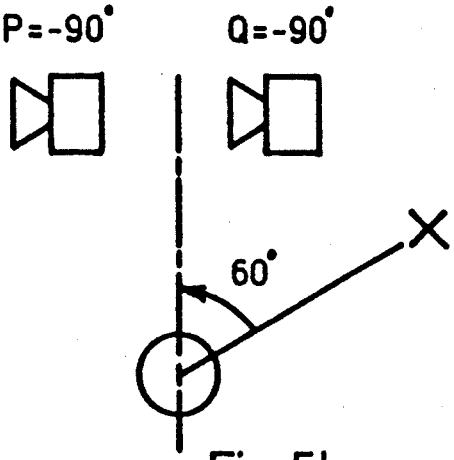
Fig. 5k
| Room Number | s | d |
|---|---|---|
| 1 | 1.0 | 1.4 |
| 2 | 1.8 | 2.5 |
| 3 | 1.8 | 2.4 |
Fig. 5m Image Transfer Process Block Diagram System Block Diagram Human Interface Human Interface: Displays Virtual Source Placement

| Signal | | Left Channel | | Right Channel | | | Image Position | |
|---|---|---|---|---|---|---|---|---|
| Freq Hz | Interval s | Amplitude V | Delay µs | Amplitude V | Delay µs | Inversion +/- | Azimuth(a) Degrees | Altitude(b) Degrees |
| 500 | 0.9 | 3.26 | 1250 | 3.77 | 160 | + | -52 | 5 |
| 750 | 0.9 | 3.26 | 950 | 3.33 | 160 | + | -52 | 5 |
| 1000 | 0.9 | 3.26 | 780 | 3.70 | 160 | + | -52 | 5 |
| 500 | 0.9 | 3.26 | 326 | 3.94 | 160 | - | -83 | 5 |
| 750 | 0.9 | 3.26 | 375 | 3.33 | 160 | - | -83 | 5 |
| 1000 | 0.9 | 3.26 | 375 | 3.26 | 160 | - | -83 | 5 |
| 6600 | 4.5 | 3.19 | 226 | 3.19 | 160 | - | -8 | 28 |
| 6800 | 4.5 | 3.19 | 229 | 3.19 | 160 | - | -8 | 29 |

Fig. 15

SOUND IMAGING METHOD AND APPARATUS

This is a division of application Ser. No. 07/696,989, filed May 2, 1991 now U.S. Pat. No. 5,105,462, which is a continuation of Appl. Ser. No. 398,988 filed Aug. 28, 1989, now abandoned, which is a continuation in part of Appl. Ser. No. 239,981 filed Sep. 2, 1988, now U.S. Pat. No. 5,046,097.

BACKGROUND OF THE INVENTION

Field of the Invention

This invention relates generally to a method and apparatus for processing an audio signal and, more particularly, to processing an audio signal so that the resultant sounds appear to the listener to emanate from a location other than the actual location of the loudspeakers.

Human listeners are readily able to estimate the direction and range of a sound source. When multiple sound sources are distributed in space around the listener, the position of each may be perceived independently and simultaneously. Despite substantial and continuing research over many years, no satisfactory theory has yet been developed to account for all of the perceptual abilities of the average listener.

A process that measures the pressure or velocity of a sound wave at a single point, and reproduces that sound effectively at a single point, will preserve the intelligibility of speech and much of the identity of music. Nevertheless, such a system removes all of the information needed to locate the sound in space. Thus, an orchestra, reproduced by such a system, is perceived as if all instruments were playing at the single point of reproduction.

Efforts were therefore directed to preserving the directional cues contained inherently in the sounds during transmission or recording and reproduction. In U.S. Pat. No. 2,093,540 issued to Alan D. Blumlein in September 1937 substantial detail for such a two-channel system is given. The artificial emphasis of the difference between the stereo channels as a means of broadening the stereo image, which is the basis of many present stereo sound enhancement techniques, is described in detail.

Some known stereo enhancement systems rely on cross-coupling the stereo channels in one way or another, to emphasis the existing cues to spatial location contained in a stereo recording. Cross-coupling and its counterpart crosstalk cancellation both rely on the geometry of the loudspeakers and listening area and so must be individually adjusted for each case.

It is clear that attempted refinements of the stereo system have not produced great improvement in the systems now in widespread use for entertainment. Real listeners like to sit at ease, move or turn their heads, and place their loudspeakers to suit the convenience of room layout and to fit in with other furniture.

OBJECT AND SUMMARY OF THE INVENTION

Thus, it is an object of the present invention to provide a method and apparatus for processing an audio signal so that when it is reproduced over two audio transducers the apparent location of the sound source can be suitably controlled, so that it seems to the listener that the location of the sound source is separated from the location of the transducers or speakers.

The present invention is based on the discovery that audio reproduction of a monaural using two independent channels and two loudspeakers can produce highly localized images of great clarity in different positions. Observation of this phenomenon by the inventors, under specialized conditions in a recording studio, led to systematic investigations of the conditions required to produce this audio illusion. Some years of work have produced a substantial understanding of the effect, and the ability to reproduce it consistently and at will.

According to the present invention, an auditory illusion is produced that is characterized by placing a sound source anywhere in the three-dimensional space surrounding the listener, without constraints imposed by loudspeaker positions. Multiple images, of independent sources and in independent positions, without known limit to their number, may be reproduced simultaneously using the same two channels. Reproduction requires no more than two independent channels and two loudspeakers and separation distance or rotation of the loudspeakers may be varied within broad limits without destroying the illusion. Rotation of the listener's head in any plane, for example to "look at" the image, does not disturb the image.

The processing of audio signals in accordance with the present invention is characterized by processing a single channel audio signal to produce a two-channel signal wherein the differential phase and amplitude between the two signals is adjusted on a frequency dependent basis over the entire audio spectrum. This processing is carried out by dividing the monaural input signal into two signals and then passing one or both of such signals through a transfer function whose amplitude and phase are, in general, non-uniform functions of frequency. The transfer function may involve signal inversion and frequency-dependent delay. Furthermore, to the best knowledge of the inventors the transfer functions used in the inventive processing are not derivable from any presently known theory. They must be characterized by empirical means. Each processing transfer function places an image in a single position which is determined by the characteristics of the transfer function. Thus, sound source position is uniquely determined by the transmission function.

For a given position there may exist a number of different transfer functions, each of which will suffice to place the image generally at the specified position.

If a moving image is required, it may be produced by smoothly changing from one transfer function to another in succession. Thus, a suitably flexible implementation of the process need not be confined to the production of static images.

Audio signals processed according to the present invention may be reproduced directly after processing, or be recorded by conventional stereo recording techniques on various media such as optical disc, magnetic tape, phono record or optical sound track, or transmitted by any conventional stereo transmission technique such as radio or cable, without any adverse effects on the auditory image provided by the invention.

The imaging process of the present invention may be also applied recursively. For example, if each channel of a conventional stereo signal is treated as a monophonic signal, and the channels are imaged to two different positions in the listener's space, a complete conventional stereo image along the line joining the positions of the images of the channels will be perceived. In addition, at the time the stereo record or disc is being recorded on multitrack tape, having for example twenty-four channels, each channel can be fed through a transfer function processor so that the recording engineer can locate the various instruments and voices at will to create a specialized sound stage. The result of this is still two-channel audio signals that can be played back on conventional reproducing equipment, but that will contain the inventive auditory imaging capability.

BRIEF DESCRIPTION OF THE DRAWINGS

FIG. 1 is a plan view representation of a listening geometry for defining parameters of image location;

FIG. 2 is a side view corresponding to FIG. 1;

FIGS. 5*a*–5*k* are plan views of respective listening situations with corresponding variations in loudspeaker placement and FIG. 5*m* is a table of critical dimensions for three listening rooms;

FIG. 15 tabulates data representing a transfer function according to an embodiment of the present invention;

DETAILED DESCRIPTION OF PREFERRED EMBODIMENTS

Figure 3:
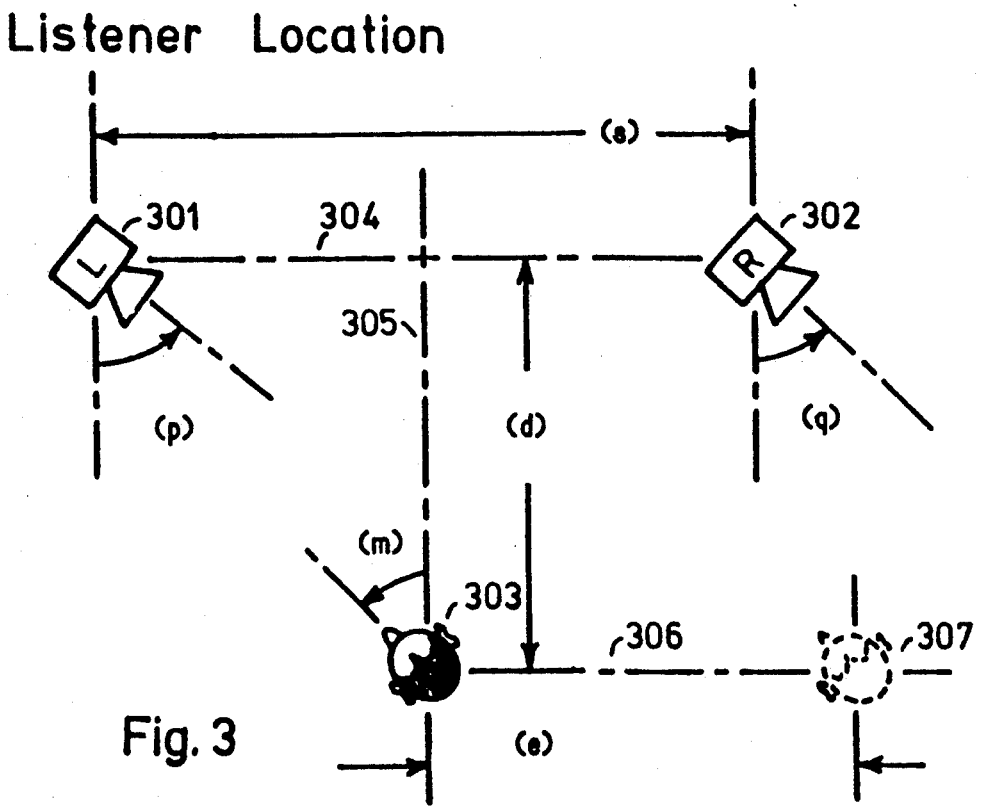
FIG. 3 is a plan view representation of a listening geometry for defining parameters of listener location.

In order to define terms that will allow an unambiguous description of the auditory imaging process according to the present invention, FIGS. 1–4 show some dimensions and angles involved.

FIG. 1 is a plan view of a stereo listening situation, showing left and right loudspeakers 101 and 102, respectively, a listener 103, and a sound image position 104 that is apparent to listener 103. For purposes of definition only, the listener is shown situated on a line 105 perpendicular to a line 106 joining loudspeakers 101 and 102, and erected at the midpoint of line 106. This listener position will be referred to as the reference listener position, but with this invention the listener is not confined to this position. From the reference listener position an image azimuth angle (a) is measured counterclockwise from line 105 to a line 107 between listener 103 and image position 104. Similarly, the image slant range (r) is defined as the distance from listener 103 to image position 104. This range is the true range measured in three-dimensional space, not the projected range as measured on the plan or other orthogonal view.

In the present invention the possibility arises of images substantially out of the plane of the speakers. Accordingly, in FIG. 2 an altitude angle (b) for the image is defined. A listener position 201 corresponds with position 103 and an image position 202 corresponds with image position 104 in FIG. 1. Image altitude angle (b) is measured upwardly from a horizontal line 203 through the head of listener 103 to a line 204 joining the listener's head to image position 202. It should be noted that loudspeakers 101, 102 do not necessarily lie on line 203.

Having defined the image positional parameters with respect to a reference listening configuration, we proceed to define parameters for possible variations in the listening configuration. Referring to FIG. 3, loudspeakers 301 and 302, and lines 304 and 305 correspond respectively to items 101, 102, 106, and 105 in FIG. 1. A loudspeaker spacing distance (s) is measured along line 304, and a listener distance (d) is measured along line 305. In the case that a listener is arranged parallel to line 304 along line 306 to position 307, we define a lateral displacement (e) measured along line 306. For each loudspeaker 301 and 302 we define respective azimuth angles (p) and (q) as measured counterclockwise from a line through loudspeakers 301, 302 and perpendicular to a line joining them, in a direction toward the listener. Similarly for the listener we define an azimuth angle (m) counterclockwise from line 305 in the direction the listener is facing.

Figure 4:
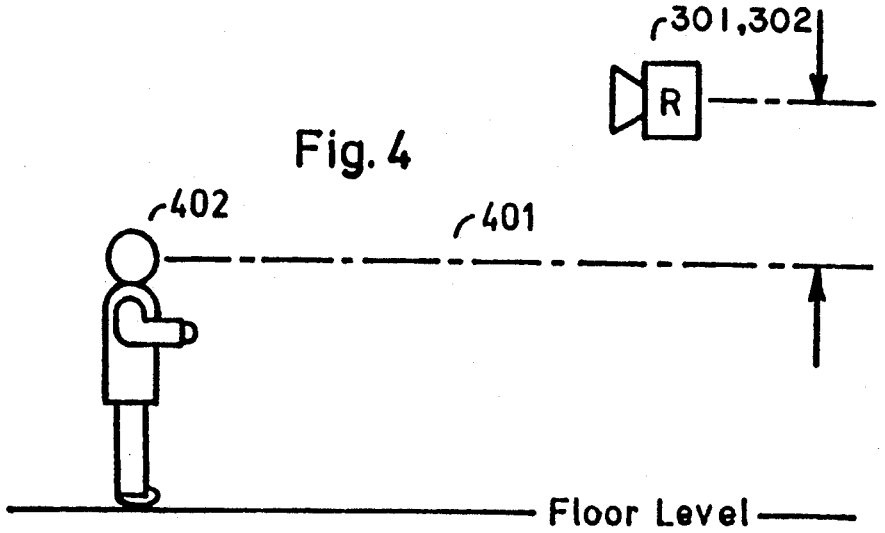
FIG. 4 is an elevational view corresponding to FIG. 4.

In FIG. 4, a loudspeaker height (h) is measured upward from the horizontal line 401 through the head of the listener 303 to the vertical centerline of loudspeaker 302.

The parameters as defined allow more than one description of a given geometry. For example, an image position may be described as (180,0,x) or (0,180,x) with complete equivalence.

In conventional stereophonic reproduction the image is confined to lie along line 106 in FIG. 1, whereas the image produced by the present invention may be placed freely in space: azimuth angle (a) may range from 0–360 degrees, and range (r) is not restricted to distances commensurate with (s) or (d). An image may be formed very close to the listener, at a small fraction of (d), or remote at a distance several times (d), and may simultaneously be at any azimuth angle (a) without reference to the azimuth angle subtended by the loudspeakers. In addition, the present invention is capable of image placement at any altitude angle (b). Listener distance (d) may vary from 0.5 m to 30 m or beyond, with the image apparently static in space during the variation.

Good image formation has ben achieved with loudspeaker spacings from 0.2 m to 8 m, using the same signals to drive the loudspeakers from all spacings. Azimuth angles at the loudspeakers (p) and (q) may be varied independently over a broad range with no effect on the image.

It is characteristic of this invention that moderate changes in loudspeaker height (h) do not affect the image altitude angle (b) perceived by the listener. This is true for both positive and negative values of (h), that is to say loudspeaker placement above or below the listener's head height.

Since the image formed is extremely realistic, it is natural for the listener to turn to "look at", that is to face directly toward, the image. The image remains stable as this is done; listener azimuth angle (m) has no perceptible effect on the spatial position of the image, for at least a range of angles (m) from +120 to −120 degrees. So strong is the impression of a localized sound source that listeners have no difficulty in "looking at" or pointing to the image; a group of listeners will report the same image position.

Figure 5A:
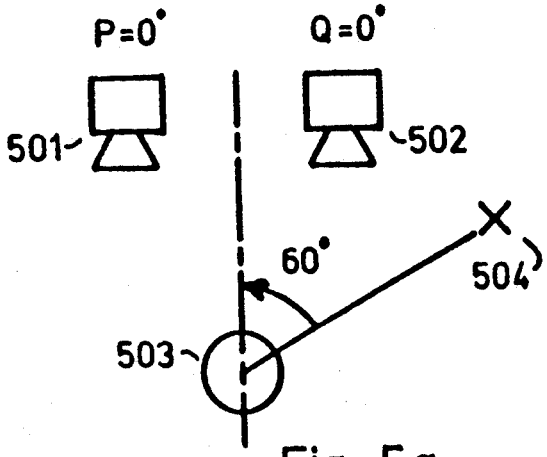
Figure 5B:
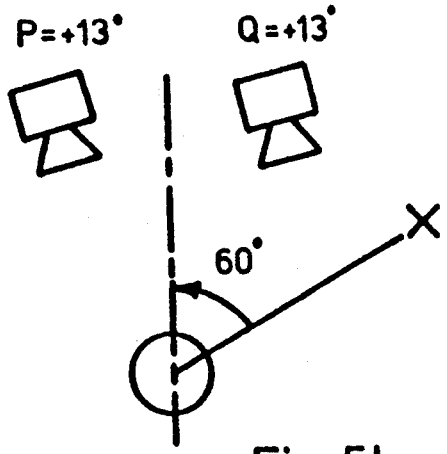
Figure 5C:
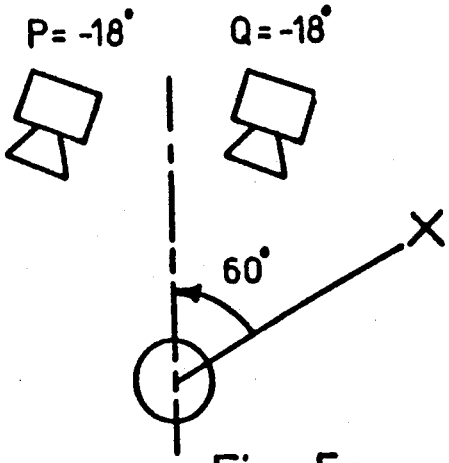
Figure 5D:
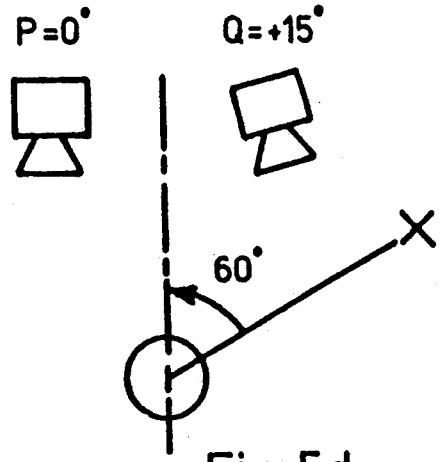
Figure 5E:
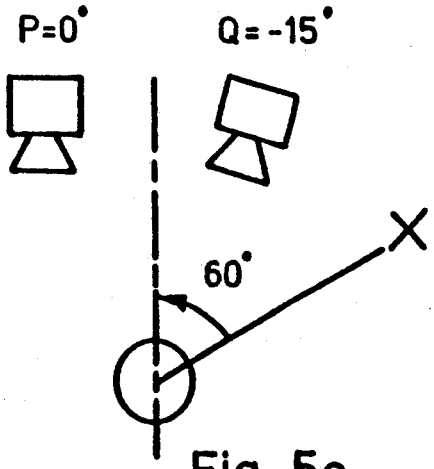
Figure 5F:
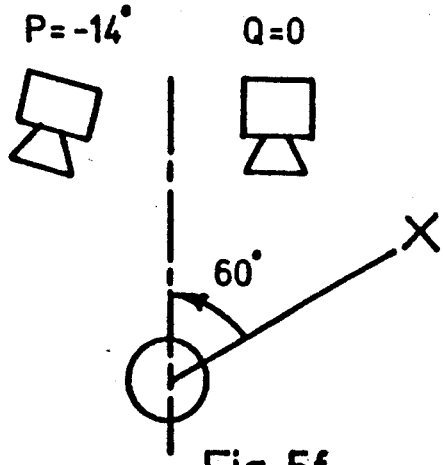

FIGS. 5*a*–5*k* shows a set of ten listening geometries in which image stability has been tested. In FIG. 5*a*, a plan view of a listening geometry is shown. Left and right loudspeakers 501 and 502 respectively reproduced sound for listener 503, producing a sound image 504. Sub-FIGS. 5*a* through 5*k* show variations in loudspeaker orientation, and are generally similar to sub-FIG. 5*a*.

All ten geometries were tested in three different listening rooms with different values of loudspeaker spacing (s) and listener distance (d), as tabulated in FIG. 5*m*. Room 1 was a small studio control area containing considerable amounts of equipment, room 2 as a large recording studio almost completely empty, and room 3 was a small experimental room with sound absorbing material on three walls.

For each test the listener was asked to give the perceived image position for two conditions; listener head angle (m) zero, and head turned to face the apparent image position. Each test was repeated with three different listeners. Thus, the image stability was tested in a total of 180 configurations. Each of these 180 configurations used the same input signals to the loudspeakers. In every case the image azimuth angle (a) was perceived as −60 degrees.

Figure 6:
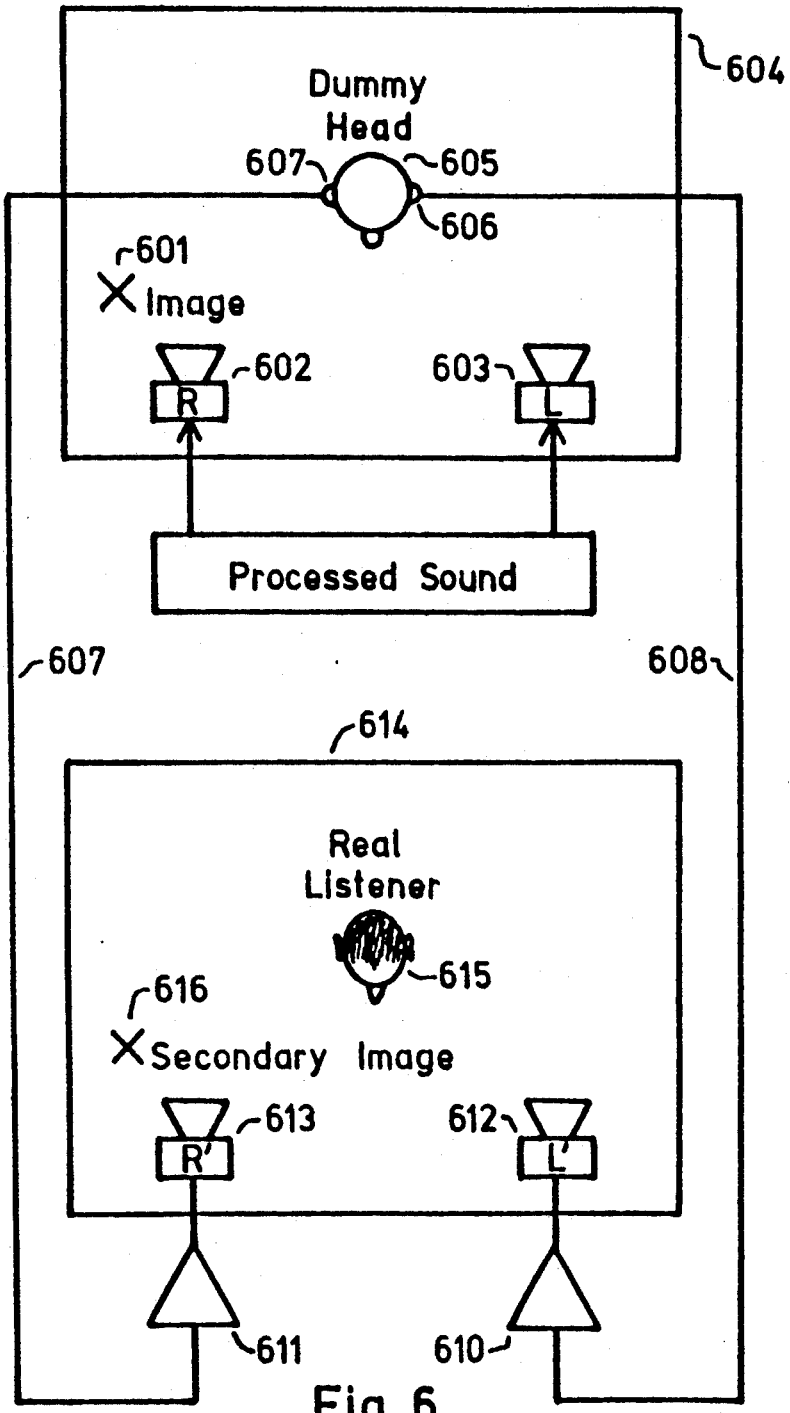
FIG. 6 is a plan view of an image transfer experiment carried out in two isolated rooms.

In FIG. 6 an image transfer experiment is shown in which a sound image 601 is formed by signals processed according to the present invention, driving loudspeakers 602 and 603 in a first room 604. A dummy head 605, such as shown for instance in German Patent 1 927 401, carries left and right microphones 606 and 607 in its model ears. Electrical signals on lines 608 and 609 from microphones 606, 607 are separately amplified by amplifiers 610 and 611, which drive left and right loudspeakers 612 and 613, respectively, in a second room 614. A listener 615 situated in this second room, which is acoustically isolated from the first room, will perceive a sharp secondary image 616 corresponding to the image 601 in the first room.

Figure 7:
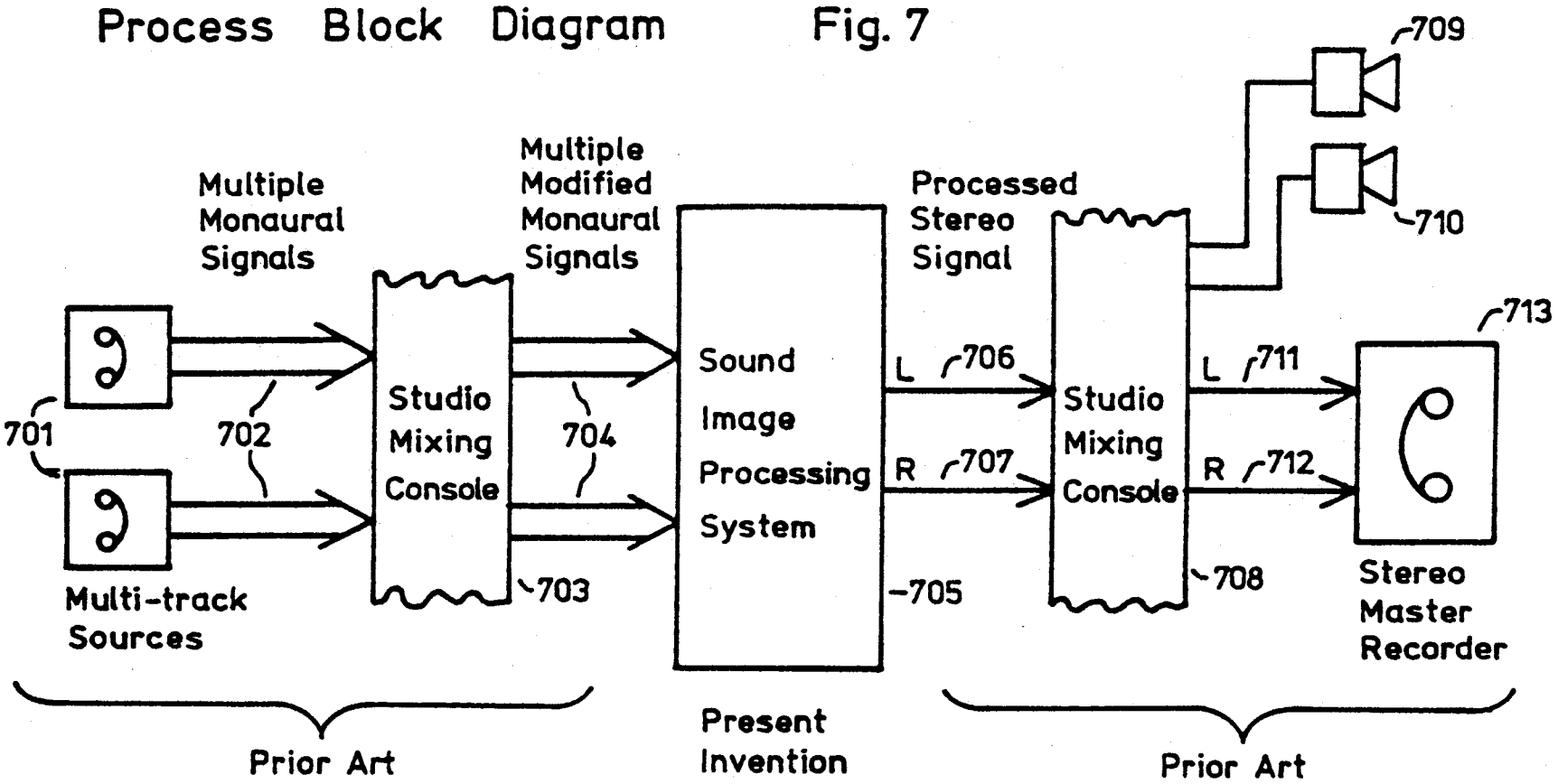
FIG. 7 is a process block diagram relating the present invention to prior art practice.

An example of the relationship of the inventive sound processor to known systems is shown in FIG. 7, in which one or more multi-track signal sources 701, which may be magnetic tape replay machines, feed a plurality of monophonic signals 702 derived from a plurality of sources to a studio mixing console 703. The console may be used to modify the signals, for instance by changing levels and balancing frequency content, in any desired ways.

A plurality of modified monophonic signals 704 produced by console 703 are connected to the inputs of an image processing system 705 according to the present invention. Within this system each input channel is assigned to an image position, and transfer function processing is applied to produce two-channel signals from each single input signal 704. All of the two-channel signals are mixed to produce a final pair of signals 706, 707, which may then be returned to a mixing console 708. It should be understood that the two-channel signals produced by this invention are not really left and right stereo signals, however, such connotation provides an easy way of referring to these signals. Thus, when all of the two-channel signals are mixed, all of the left signals are combined into one signal and all of the right signals are combined into one signal. In practice, console 703 and console 708 may be separate sections of the same console. Using console facilities, the processed signals may be applied to drive loudspeakers 709, 710 for monitoring purposes. After any required modification and level setting, master stereo signals 711 and 712 are led to master stereo recorder 713, which may be a two-channel magnetic tape recorder. Items subsequent to item 705 are well known in the prior art.

Figure 8:
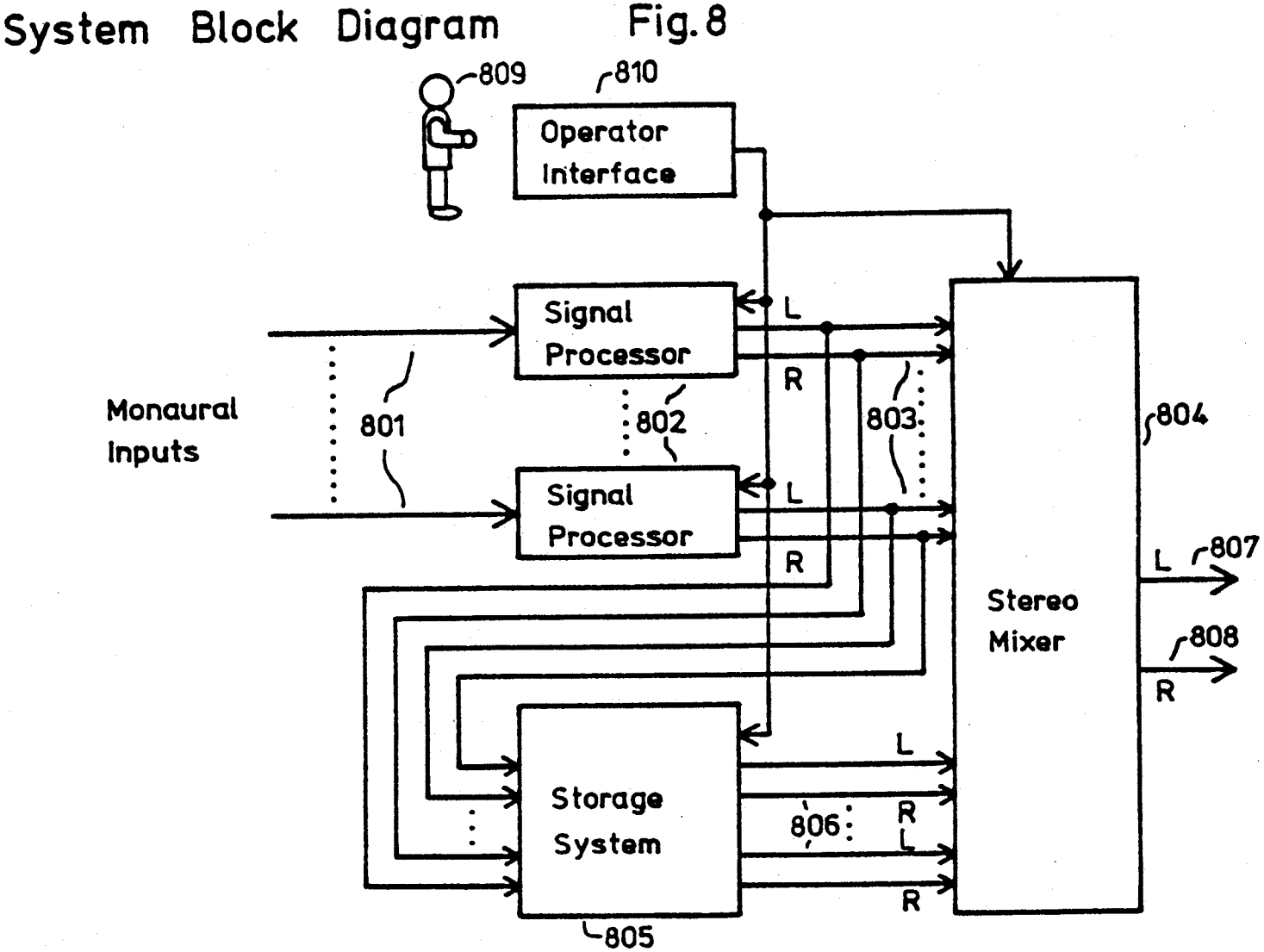
FIG. 8 is a schematic in block diagram form of a sound imaging system according to an embodiment of the present invention.

Sound image processing system 705 is shown in more detail in FIG. 8, in which input signals 801 correspond to signals 704 and output signals 807, 808 correspond respectively to signals 711, 712 of FIG. 7. Each monaural input signal 801 is fed to an individual signal processor 802.

These processors 802 operate independently, with no intercoupling of audio signals. Each signal processor operates to produce the two-channel signals having differential phase and amplitude adjusted on a frequency dependent basis. These transfer functions will be explained in detail below. The transfer functions, which may be described in the time domain as real impulse responses or equivalently in the frequency domain as complex frequency responses or amplitude and phase responses, characterize only the desired image position to which the input signal is to be projected.

One or more processed signal pairs 803 produced by the signal processors are applied to the inputs of stereo mixer 804. Some or all of them may also be applied to the inputs of a storage system 805. This system is capable of storing complete processed stereo audio signals, and of replaying them simultaneously to appear at outputs 806. Typically this storage system may have different numbers of input channel pairs and output channel pairs. A plurality of outputs 806 from the storage system are applied to further inputs of stereo mixer 804. Stereo mixer 804 sums all left inputs to produce left output 807, and all right inputs to produce right output 808, possibly modifying the amplitude of each input before summing. No interaction or coupling of left and right channels takes place in the mixer.

A human operator 809 may control operation of the system via human interface means 810 to specify the desired image position to be assigned to each input channel.

It may be particularly advantageous to implement signal processors 802 digitally, so that no limitation is placed on the position, trajectory, or speed of motion of an image. These digital sound processors that provide the necessary differential adjustment of phase and amplitude on a frequency dependent basis will be explained in more detail below. In such a digital implementation it may not always be economic to provide for signal processing to occur in real time, though such operation is entirely feasible. If real-time signal processing is not provided, outputs 803 would be connected to storage system 805, which would be capable of slow recording and real-time replay. Conversely, if an adequate number of real-time signal processors 802 are provided, storage system 805 may be omitted.

Figure 9:
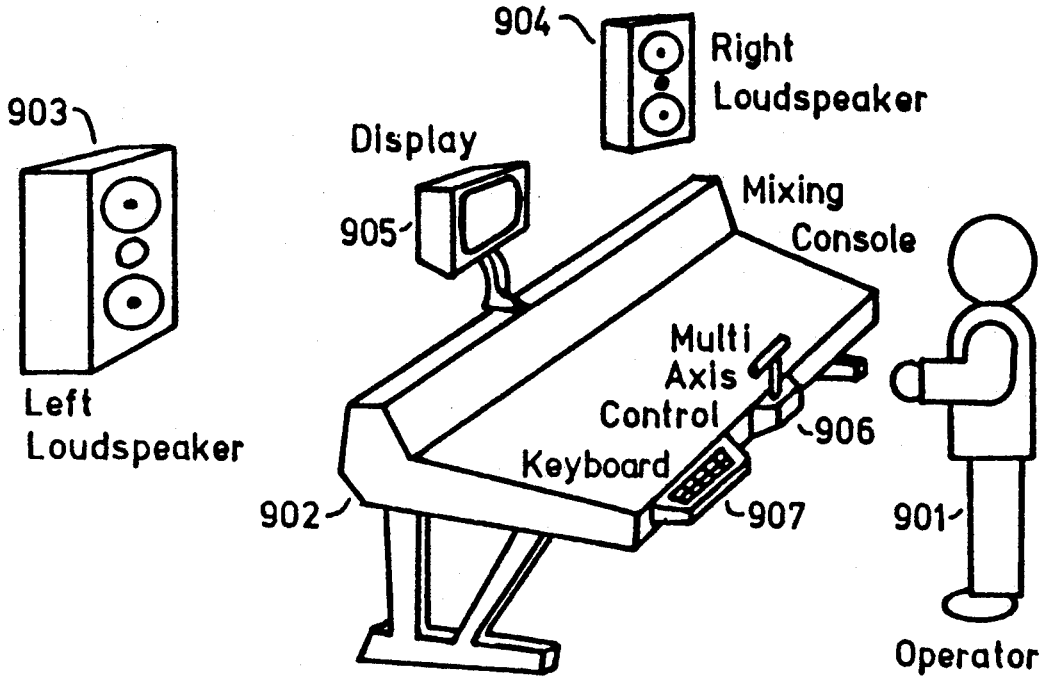
FIG. 9 is a pictorial representation of an operator workstation according to an embodiment of the present invention.

In FIG. 9, operator 901 controls mixing console 902 equipped with left and right stereo monitor loudspeakers 903, 904. Although stability of the final processed image is good to a loudspeaker spacing (s) as low as 0.2 m, it is preferable for the mixing operator to be provided with loudspeakers placed at least 0.5 m apart. With such spacing, accurate image placement is more readily achieved. A computer graphic display means 905, a multi-axis control 906, and a keyboard 907 are provided, along with suitable computing and storage facilities to support them.

Figure 10:
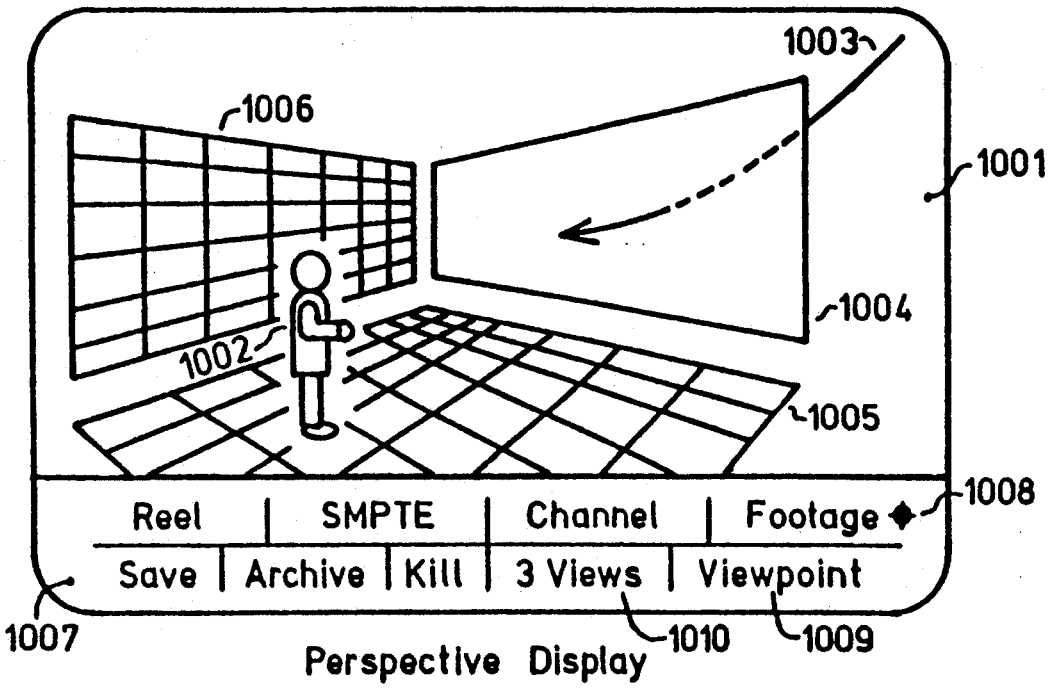
FIG. 10 depicts a computer-graphic perspective display used in controlling the present invention.
Figure 11:
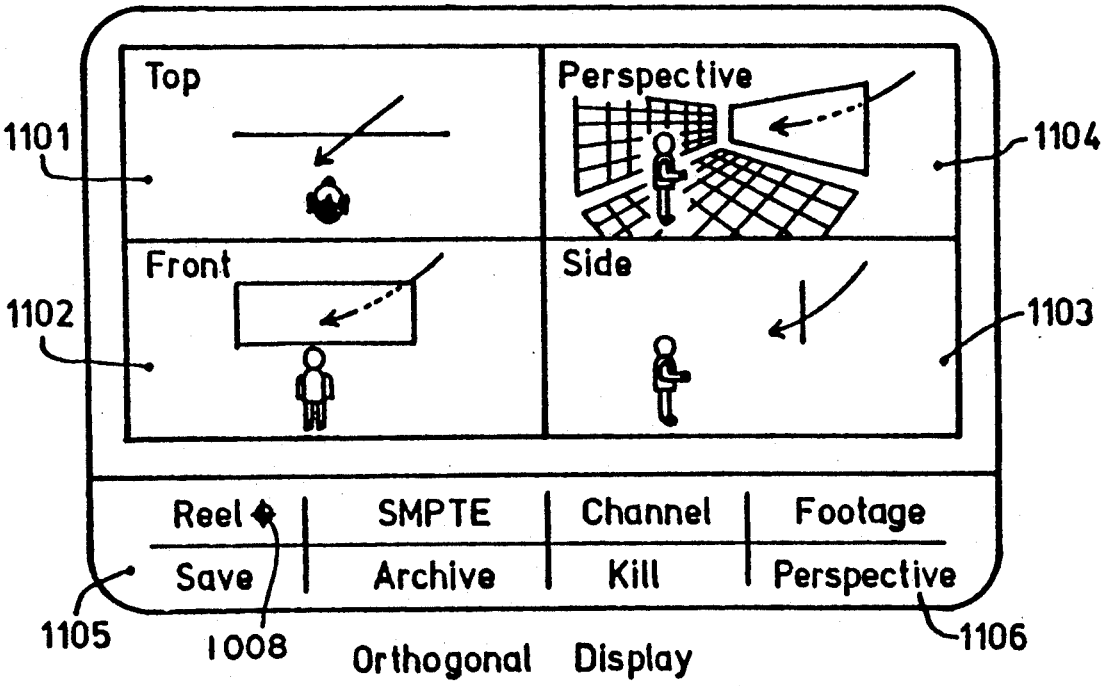
FIG. 11 depicts a computer-graphic display of three orthogonal views used in controlling the present invention.

Computer graphic display means 905 may provide a graphic representation of the position or trajectory of the image in space as shown, for example, in FIGS. 10 and 11. FIG. 10 shows a display 1001 of a listening situation in which a typical listener 1002 and an image trajectory 1003 are presented, along with a representation of a motion picture screen 1004 and perspective space cues 1005, 1006.

At the bottom of the display is a menu 1007 of items relating to the particular section of sound track being operated upon, including recording, time synchronization, and editing information. Menu items may be selected by keyboard 907, or by moving cursor 1008 to the item, using multi-axis control 906. The selected item can be modified using keyboard 907, or toggled using a button on multi-axis control 906, invoking appropriate system action. In particular, a menu item 1009 allows an operator to link the multi-axis control 906 by software to control the viewpoint from which the perspective view is projected, or to control the position/trajectory of the current sound image. Another menu item 1010 allows selection of an alternate display illustrated in FIG. 11.

In the display of FIG. 11 the virtually full-screen perspective presentation 1001 shown in FIG. 10 is replaced by a set of three orthogonal views of the same scene; a top view 1101, a front view 1102, and a side view 1103. To aid in interpretation the remaining screen quadrant is occupied by a reduced and less detailed version 1104 of the perspective view 1001. Again a menu 1105, substantially similar to that shown at 1007 and with similar functions, occupies the bottom of the screen. One particular menu item 1106 allows toggling back to the display of FIG. 10.

Figure 12:
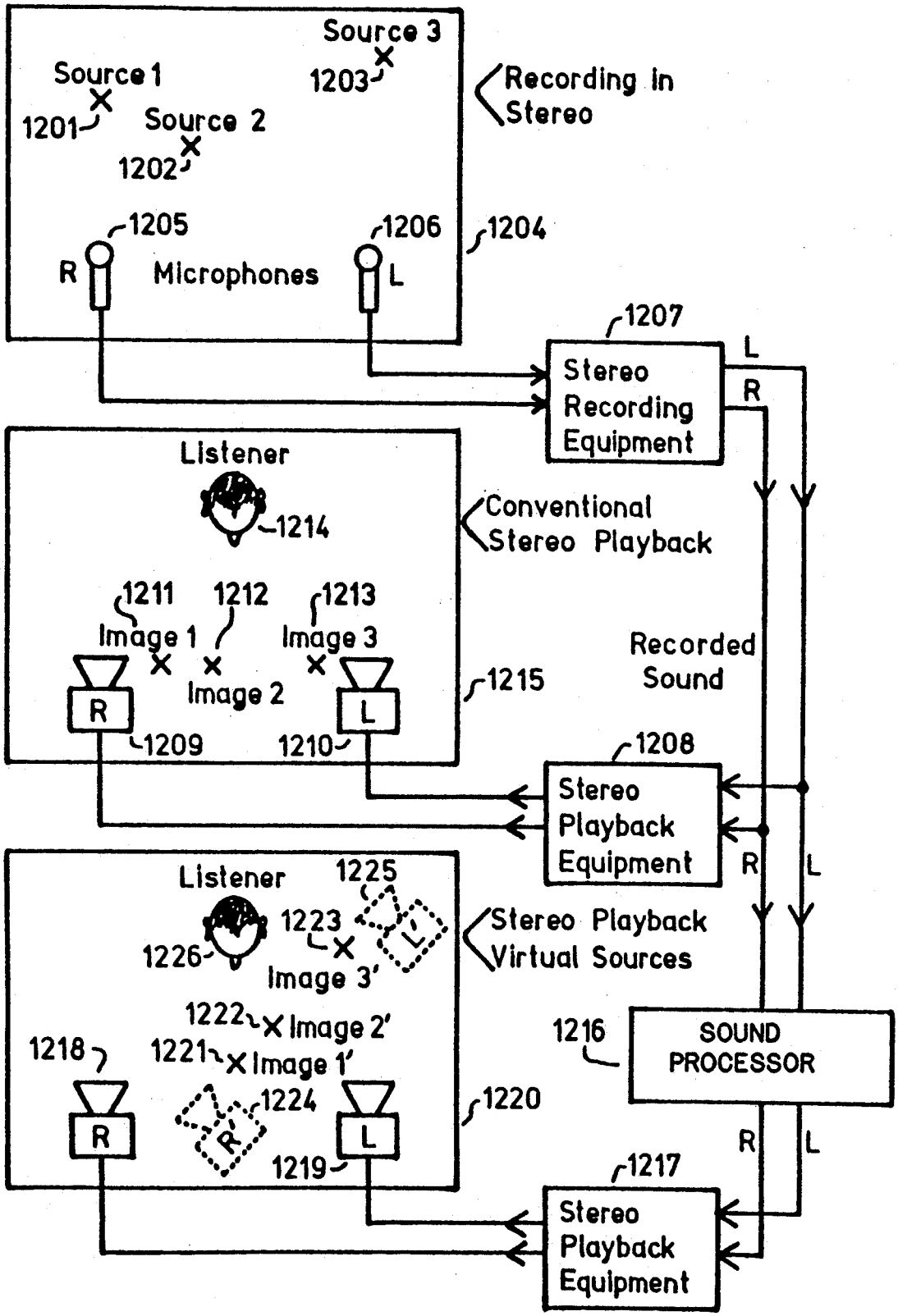
FIG. 12 is a schematic representation of the formation of virtual sound sources by the present invention, showing a plan view of three isolated rooms.

In FIG. 12, sound sources 1201, 1202, and 1203 in a first room 1204 are detected by two microphones 1205 and 1206 that generate right and left stereo signals, respectively, that are recorded using conventional stereo recording equipment 1207. If replayed on conventional stereo replay equipment 1208, driving right and left loudspeakers 1209, 1210, respectively, with the signals originating from microphones 1205, 1206, conventional stereo images 1211, 1212, 1213 corresponding respectively to sources 1201, 1202, 1203 will be perceived by a listener 1214 in a second room 1215. These images will be at positions that are projections onto the line joining loudspeakers 1209, 1210 of the lateral positions of the sources relative to microphones 1205, 1206.

If the two pairs of stereo signals are processed and combined as detailed above using sound processor 1216, and reproduced by conventional stereo playback equipment 1217 on right and left loudspeakers 1218, 1219 in a third room 1220, crisp spatially localized images of the sound sources are apparent to listener 1226 at positions unrelated to the actual positions of loudspeakers 1218, 1219. Let us suppose that the processing was such as to form an image of the original right channel signal at position 1224, and an image of the original left channel signal at 1225. Each of these images behaves as if it were truly a loudspeaker; we may think of the images as "virtual loudspeakers".

A transfer function in which both differential amplitude and phase of a two-channel signal are adjusted on a frequency dependent basis across the entire audio band is required to project an image of a monaural audio signal to a given position. For general applications to specify each such response, the amplitude and phase differential at intervals not exceeding 40 Hz must be specified independently for each of the two channels over the entire audio spectrum, for best image stability and coherence. For applications not requiring high quality and sound image placement the frequency intervals may be expanded. Hence specification of such a response requires about 1000 real numbers (or equivalently, 500 complex ones). Differences for human perception of auditory spatial location are somewhat indefinite, being based on subjective measurement, but in a true three-dimensional space more than 1000 distinct positions are resolvable by an average listener. Exhaustive characterization of all responses for all possible positions therefore constitutes a vast body of data, comprising in all more than on million real numbers, the collection of which is in progress.

It should be noted that is the transfer function in the sound processor according to this invention, which provides the differential adjustment between the two channels, is build up piece-by-piece by trial and error testing over the audio spectrum for each 40 Hz interval. Moreover, as will be explained below, each transfer function in the sound processor locates the sound relative to two spaced-apart transducers at only one location, that is, one azimuth, height, and depth.

In practice, however, we need not represent all transfer function responses explicitly, as mirror-image symmetry generally exists between the right and left channels. If the responses modifying the channels are interchanged, the image azimuth angle (a) is inverted, whilst the altitude (b) and range (r) remain unchanged.

It is possible to demonstrate the inventive process and the auditory illusion using conventional equipment and by using simplified signals. If a burst of a sine wave at a known frequency is gated smoothly on and off at relatively long intervals, a very narrow band of the frequency domain is occupied by the resulting signal. Effectively, this signal will sample the required response at a single frequency. Hence the required responses, that is, the transfer functions, reduce to simple control of differential amplitude and phase (or delay) between the left and right channels on a frequency dependent basis. Thus, it will be appreciated that the transfer function for a specific sound placement can be built up empirically by making differential phase and amplitude adjustments for each selected frequency interval over the audio spectrum. By Fourier's theorem any signal may be represented as the sum of a series of sine waves, so the signal used is completely general.

Figure 13:
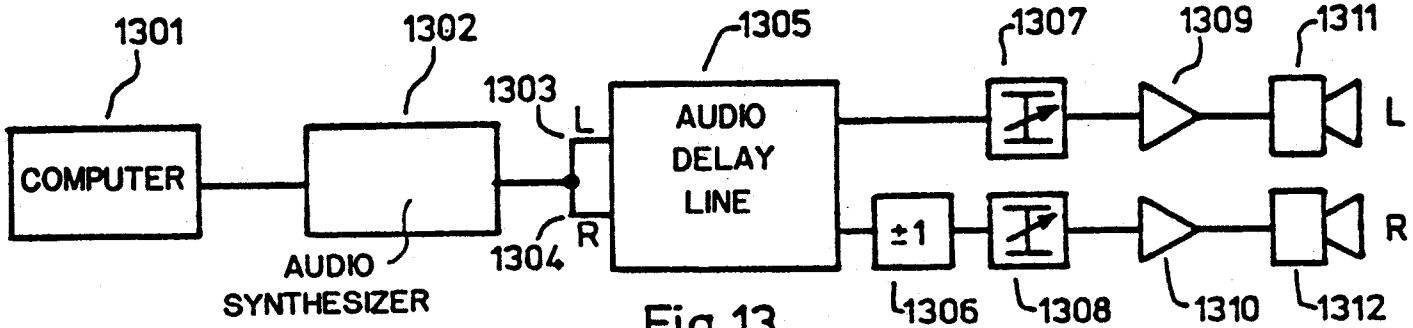
FIG. 13 is a schematic in block diagram form of equipment for demonstrating the present invention.

An example, of a system for demonstrating the present invention is shown in FIG. 13, in which an audio synthesizer 1302, a Hewlett-Packard Multifunction Synthesizer model 8904A, is controlled by a computer 1301, Hewlett-Packard model 330M, to generate a monaural audio signal that is fed to the inputs 1303, 1304 of two channels of an audio delay line 1305, Eventide Precision Delay model PD860. From delay line 1305 the right channel signal passes to a switchable inverter 1306 and left and right signals then pass through respective variable attentuators 1307, 1308 and hence to two power amplifiers 1309, 1310 driving left and right loudspeakers 1311, 1312, respectively.

Figure 14:
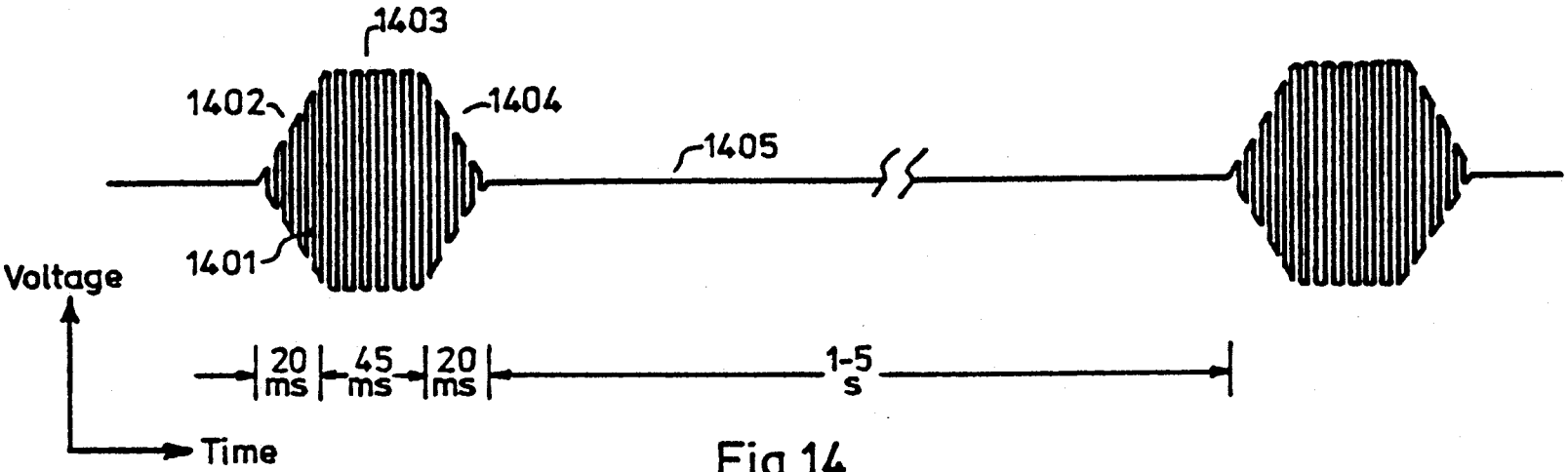
FIG. 14 is a waveform diagram of a test signal plotted as voltage against time.

Synthesizer 1302 produces smoothly gated sine wave bursts of any desired test frequency 1401, using an envelope as shown in FIG. 14. The sine wave is gated on using a first linear ramp 1402 of 20 ms duration, dwells at constant amplitude 1403 for 45 ms, and is then gated off using a second linear ramp 1404 of 20 ms duration. Bursts are repeated at intervals 1405 of about 1–5 second.

In addition, using the system of FIG. 13 and the waveform of FIG. 14, the present invention can build up a transfer function over the audio spectrum by adjusting the time delay in delay line 1305 and the amplitude by attentuators 1307, 1308. A listener would make the adjustment, listen to the sound placement and determine if it was in the right location. If so, the next frequency interval would be examined. If not, then further adjustments are made and the listening process repeated. In this way the transfer function over the audio spectrum can be built-up.

FIG. 15 is a table of practical data to be used to form a transfer function suitable to allow reproduction of auditory images well off the direction of the loudspeakers for several sine wave frequencies. This table might be developed just as explained above, by trial and error listening. All of these images were found to be stable and repeatable in all three listening rooms detailed in FIG. 5*m*, for a broad range of listener head attitudes including directly facing the image, and for a variety of listeners.

We may generalize the placement of narrowband signals, detailed above, in such a manner as to permit broadband signals, representing complicated sources such as speech and music, to be imaged. If the differential amplitudes and phase shifts for the two channels that are derived from a single input signal are specified for all frequencies though the audio band, the complete transfer function is specified. In practice, we need only explicitly specify the differential amplitudes and delays for a number of frequencies in the band of interest. Amplitudes and delays at any intermediate frequency, between those specified, may then be found by interpolation. If the frequencies at which the response is specified are not too widely spaced, and taking into account the smoothness or rate of change of the true response represented, the method of interpolation is not too critical.

Figure 16:
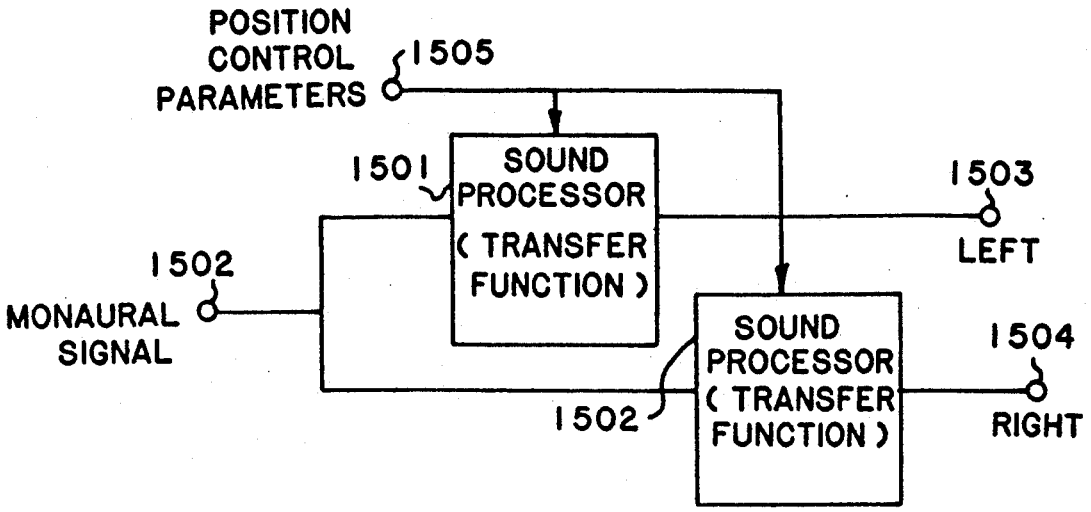
FIG. 16 is a schematic in block diagram form of a sound image location system according to an embodiment of the present invention.

In the table of FIG. 15, the amplitudes and delays are applied to the signal in each channel and this is shown generally in FIG. 16 in which a separate sound processor 1500, 1501 is provided. The single channel audio signal is fed in at 1502 and fed to both sound processors 1500, 1501 where the amplitude and phase are adjusted on a frequency dependent basis so that the differential at the left and right channel outputs 1503, 1504, respectively, is the correct amount that was empirically determined, as explained above. The control parameters fed in on line 1505 change the differential phase and amplitude adjustment so that the sound image can be at a different, desired location. For example, in a digital implementation the sound processors could be finite impulse response (FIR) filters whose coefficients are varied by the control parameter signal to provide different effective transfer functions.

The system of FIG. 16 can be simplified, as shown from the following analysis. Firstly, only the difference or differential between the delays of the two channels is of interest. Suppose that the left and right channel delays are t(1) and t(r) respectively. New delays t'(1) and t'(r) are defined by adding any fixed delay t(a), such that:

$$t'(1)=t(1)+t(a) \quad (1)$$

$$t'(r)=t(r)+t(a) \quad (2)$$

The result is that the entire effect is heard a time t(a) later, or earlier where t(a) is negative. This general expression holds in the special case where t(a)=−t(r). Substituting:

$$t'(1)=t(1)-t(r) \quad (3)$$

$$t'(r)=t(r)-t(r)=0 \quad (4)$$

By this transformation we can always reduce the delay in one channel to zero. In a practical implementation we must be careful to substract out the smaller delay, so that the need for a negative delay never arises. It may be preferred to avoid this problem by leaving a fixed residual delay in one channel, and changing the delay in the other. If the fixed residual delay is of sufficient magnitude, the variable delay need not be negative.

Secondly, we need not control channel amplitudes independently. It is a common operation in audio engineering to change the amplitudes of signals either by amplification or attenuation. So long as both stereo channels are changed by the same ratio, there is no change in the positional information carried. It is the ratio or differential of amplitudes that is important and must be preserved. So long as this differential is preserved, all of the effects and illusions in this description are entirely independent of the overall sound level of reproduction. Accordingly, by an operation similar to that detailed above for timing or phase control, we may place all of the amplitude control in one channel, leaving the other at a fixed amplitude. Again, it may be convenience to apply a fixed residual attentuation to one channel, so that all required ratios are attainable by attenuation of the other. Full control is then available using a variable attenuator in one channel only.

We may thus specify all the required information by specifying the differential attentuation and delay as functions of frequency for a single channel. A fixed, frequency-independent attentuation and delay may be specified for the second channel; if these are left unspecified, we assume unity gain and zero delay.

Thus, for any one sound image position, and therefore any one left/right transfer function, the differential phase and amplitude adjusting (filtering) may be organized all in one channel or the other or any combination in between. One of sound processors 1500, 1501 can be simplified to no more than a variable impedance or to just a straight wire. It can not be an open circuit. Assuming that the phase and amplitude adjusting is performed in only one channel to provide the necessary differential between the two channels the transfer functions would then be represented as in FIGS. 17A and 17B.

Figure 17A:
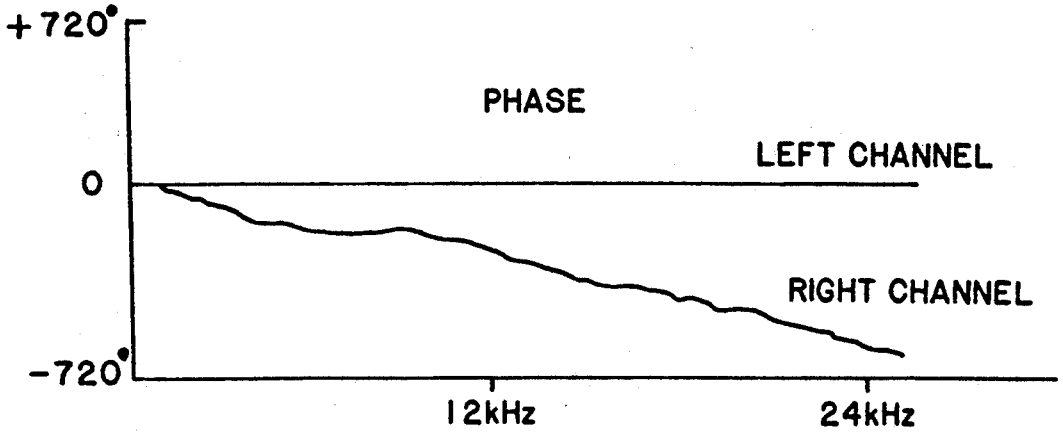
FIGS. 17A and 17B are graphical representations of typical transfer functions employed in the sound processors of FIG. 16.
Figure 17B:
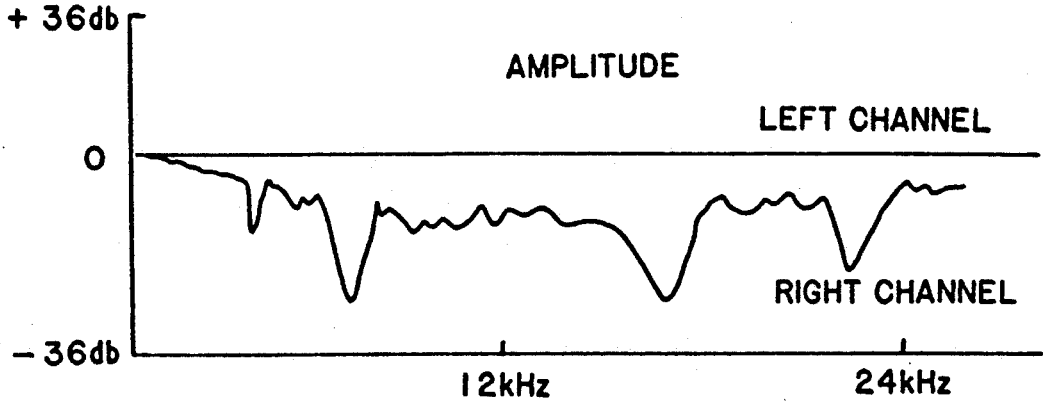

FIGS. 17A represents a typical transfer function for the differential phase of the two channels, wherein the left channel is unaltered and the right channel undergoes phase adjustment on a frequency dependent basis over the audio spectrum. Similarly, FIG. 17B represents generally a typical transfer function for the differential amplitude of the two channels, wherein the amplitude of the left channel is unaltered and the right channel undergoes attentuation on a frequency dependent basis over the audio spectrum.

It is appreciated that the sound positioners: 1500, 1501 of FIG. 16, for example, can be analog or digital and may include some or all of the following circuit elements: filters, delays, invertors, summers, amplifiers, and phase shifters. These functional circuit elements can be organized in any fashion that results in the transfer function.

Several equivalent representations of this information are possible, and are commonly used in related arts.

For example, the delay may be specified as a phase change at any given frequency, using the equivalences:

$$Phase\ (degrees) = 360 \times (delay\ time) \times frequency$$

$$Phase\ (radians) = 2 \times \times (delay\ time) \times frequency$$

Caution in applying this equivalence is required, because it is not sufficient to specify the principal value of phase; the full phase is required if the above equivalences are to hold.

A convenient representation commonly used in electronic engineering is the complex s-plane representation. All filter characteristics realizable using real analog components (any many that are not) may be specified as a ratio of two polynomials in the Laplace complex frequency variable s. The general form is:

$$T(s) = \frac{Ein(s)}{Eout(s)} = \frac{N(s)}{D(s)} \quad (5)$$

Where T(s) is the transfer function in the s plane, Ein(s) and Eout(s) are the input and output signals respectively as functions of s, and the numerator and denominator functions N(s) and D(s) are of the form:

$$N(s) = a_o + a_1 s + a_2 s^2 + a_3 s^3 + \ldots + a_n s^n \quad (6)$$

$$D(s) = b_o + b_1 s + b_2 s^2 + b_3 s^3 + \ldots + b_n s^n \quad (7)$$

The attraction of this notation is that it may be very compact. To specify the function completely at all frequencies, without need of interpolation, we need only specify the n+1 coefficients a and the n+1 coefficients b. With these coefficients specified, the amplitude and phase of the transfer function at any frequency may readily be derived using well-known methods. A further attraction of this notation is that it is the form most readily derived from analysis of an analog circuit, and therefore, stands as the most natural, compact, and well-accepted method of specifying the transfer function of such a circuit.

Yet another representation convenient for use in describing the present invention is the z-plane representation. In the preferred embodiment of the present invention, the signal processor will be implemented as digital filters in order to obtain the advantage of flexibility. Since each image position may be defined by a transfer function, we need a form of filter in which the transfer function may be readily and rapidly realized with a minimum of restrictions as to which functions may be achieved. A fully programmable digital filter is appropriate to meet this requirement.

Such a digital filter may operate in the frequency domain, in which case, the signal is first Fourier transformed to move it from a time domain representation to a frequency domain one. The filter amplitude and phase response, determined by one of the above methods, is then applied to the frequency domain representation of the signal by complex multiplication. Finally, an inverse Fourier transform is applied, bringing the signal back to the time domain for digital to analog conversion.

Alternatively, we may specify the response directly in the time domain as a real impulse response. This response is mathematically equivalent to the frequency domain amplitude and phase response, and may be obtained from it by application of an inverse Fourier transform. We may apply this impulse response directly in the time domain by convolving it with the time domain representation of the signal. It may be demonstrated that the operation of convolution in the time domain is mathematically identical with the operation of multiplication in the frequency domain, so that the direct convolution is entirely equivalent to the frequency domain operation detailed in the preceding paragraph.

Since all digital computations are discrete rather than continuous, a discrete notation is preferred to a continuous one. It is convenient to specify the response directly in terms of the coefficients which will be applied in a recursive direct convolution digital filter, and this is readily done using a z-plane notation that parallels the s-plane notation. Thus, if T(z) is s time domain response equivalent to T(s) in the frequency domain:

$$T(z) = \frac{N(z)}{D(z)} \quad (8)$$

Where N(z) and D(z) have the form:

$$N(z) = c_o + c_1 z^{-1} + c_2 z^{-2} + \ldots + c_n z^{-n} \quad (9)$$

$$D(z) = d_o + d_1 z^{-1} + d_2 z^{-2} + \ldots + d_m a^{-m} \quad (10)$$

In this notation the coefficients c and d suffice to specify the function as the a and b coefficients did in the s-plane, so equal compactness is possible. The z-plane filter may be implemented directly if the operator z is interpreted such that $z^{-1}$ is a delay of n sampling intervals.

Then the specifying coefficients c and d are directly the multiplying coefficients in the implementation. We must restrict the specification to use only negative powers of z, since these corresponds to positive delays. A positive power of z would correspond to a negative delay, that is a response before a stimulus was applied.

With these notations in hand we may described equipment to allow placement of images of broad and sounds such as speech and music. For these purposes the sound processor of the present invention, for example, processor 802 of FIG. 8, may be embodied as a variable two-path analog filter with variable path coupling attenuators as in FIG. 18A.

Figure 18A:
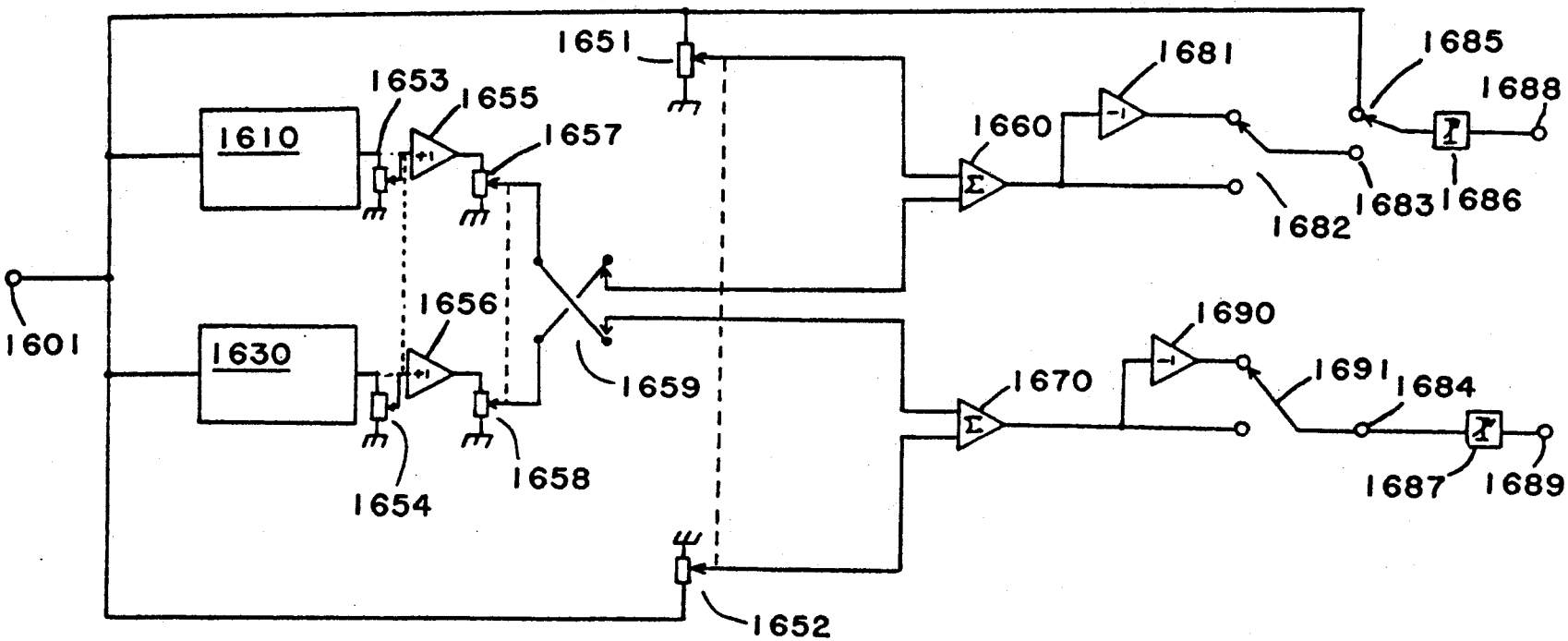
FIG. 18A–18D are schematic block diagrams of a circuit embodying the present invention.

In FIG. 18A, a monophonic or monaural input signal 1601 is input to two filters 1610, 1630 and also to two potentiometers 1651, 1652. The outputs from filters 1610, 1630 are connected to potentiometers 1653, 1654.

The four potentiometers 1651–1654 are arranged as a so-called joystick control such that they act differentially. One joystick axis allows control of potentiometers 1651, 1652; as one moves such as to pass a greater proportion of its input to its output, the other is mechanically reversed and passes a smaller proportion of its input to its output. Potentiometers 1653, 1654 are similarly differentially operated on a second, independent joystick axis. Output signals from potentiometers 1653, 1654 are passed to unity gain buffers 1655, 1656 respectively, which in turn drive potentiometers 1657, 1658, respectively, that are coupled to act together; they increase or decrease the proportion of input passed to the output in step. The output signals from potentiometers 1657, 1658 pass to a reversing switch 1659, which allows the filter signals to be fed directly or interchanged, to first inputs of summing elements 1660, 1670.

Each responsive summing element 1660, 1670 receives at its second input an output from potentiometers 1651, 1652. Summing element 1670 drives inverter 1690, and switch 1691 allows selection of the direct or inverted signal to drive input 1684 of attenuator 1689. The output of attenuator 1689 is the so-called right-channel signal. Similarly summing element 1660 drives inverter 1681, and switch 1682 allows selection of the direct or inverted signal at point 1683. Switch 1685 allows selection of the signal 1683 or the input signal 1601 as the drive to attenuator 1686 which produces left channel output 1688.

Figure 18B:
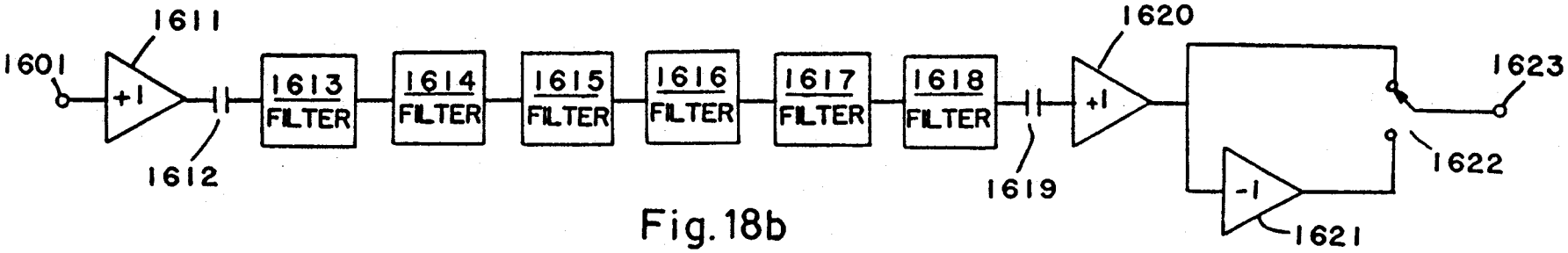

Filters 1610, 1630 are identical, and one is shown in detail in FIG. 18B. A unity gain buffer 1611 receives the input signal 1601 and is capacitively coupled via capacitor 1612 to drive filter element 1613. Similar filter elements 1614 to 1618 are cascaded, and final filter element 1618 is coupled via capacitor 1619 and unity gain buffer 1620 to drive inverter 1621. Switch 1622 allows selection of either the output of buffer 1620 or of inverter 1621 at filter output 1623.

Figure 18D:
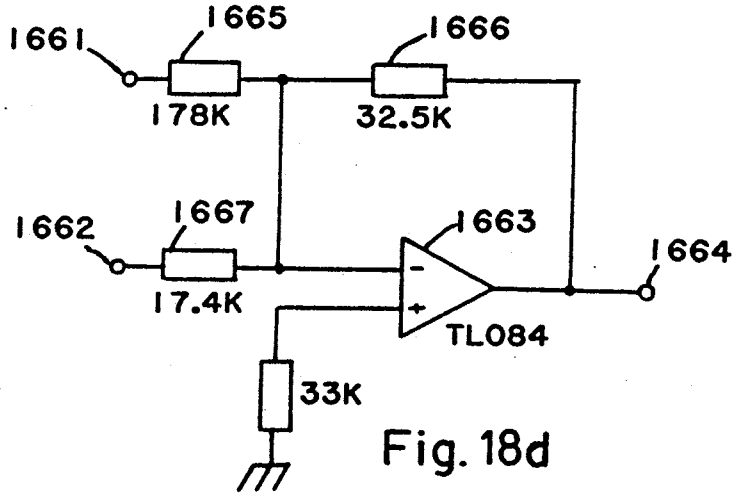
Figure 18C:
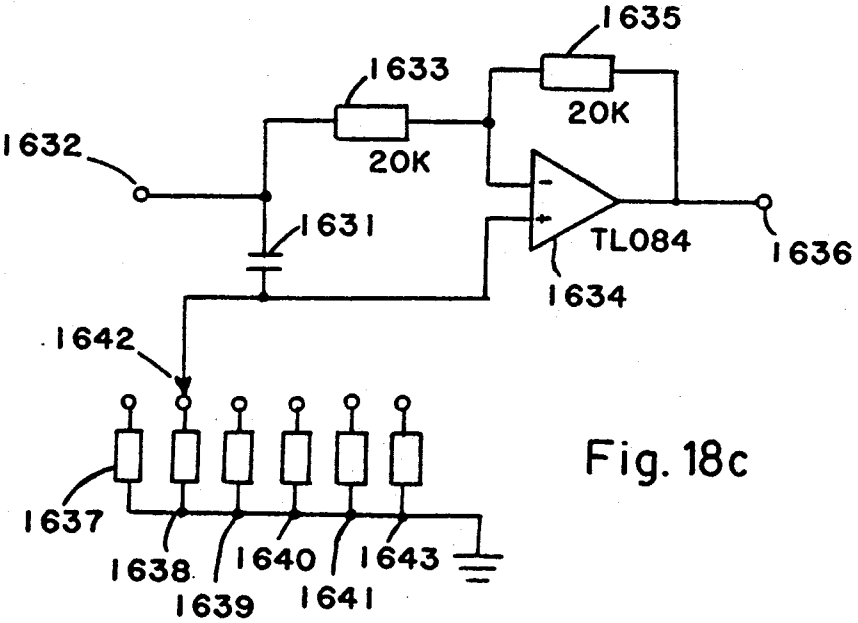

Filter elements 1613 through 1618 are identical and are shown in detail in FIG. 18C. They differ only in the value of their respective capacitor 1631. Input 1632 is connected to capacitor 1631 and resistor 1633 and resistor 1633 is coupled to the inverting input of operational amplifier 1634, output 1636 is the filter element output. Feedback resistor 1635 is connected to operational amplifier 1634 in the conventional fashion. The non-inverting input of operational amplifier 1634 is driven from the junction of capacitor 1631 and one of resistors 1637 to 1642, as selected by switch 1643. This filter is an all-pass filter with a phase shift that varies with frequency according to the setting of switch 1643.

Table 1 lists the values of capacitor 1631 used in each filter element 1613–1618, and Table 2 lists the resistor values selected by switch 1642; these resistor values are the same for all filter elements 1613–1618.

One embodiment of summing elements 1660, 1670 is shown in FIG. 18D, in which two inputs 1661, 1662 for summing in operational amplifier 1663 result in a single output 1664. The gains from input to output are determined by the resistors 1665, 1667 and feedback resistor 1666. In both cases input 1662 is driven from switch 1659, and input 1661 from joystick potentiometers 1651, 1652 respectively.

As examples of image placement, Table 3 shows settings and corresponding image positions to "fly" a sound image corresponding to a helicopter at positions well above the plane including the loudspeakers and the listener. To obtain the required monophonic signal for the process according to the present invention, the stereo tracks on the sound effects disc were summed. With the equipment shown set up as tabulated, realistic sound images are projected in space in such a manner that the listener perceives a helicopter at the locations tabulated.

TABLE 1

| Filter # | 1 | 2 | 3 | 4 | 5 | 6 |
|---|---|---|---|---|---|---|
| Capacitor 1631 Value, nF | 100 | 47 | 33 | 15 | 10 | 4.7 |

TABLE 2

| Switch 1642 Position # | 1 | 2 | 3 | 4 | 5 |
|---|---|---|---|---|---|
| Resistor # | 1637 | 1638 | 1639 | 1640 | 1641 |
| Resistor value, Ohms | 4700 | 1000 | 470 | 390 | 120 |

TABLE 3

| | | |
|---|---|---|
| Filter 1630 element 1 switch pos. | 5 | 5 |
| Filter 1630 element 2 switch pos. | 5 | 5 |
| Filter 1630 element 3 switch pos. | 5 | 5 |
| Filter 1630 element 4 switch pos. | 5 | 5 |
| Filter 1630 element 5 switch pos. | 5 | 5 |
| Filter 1630 inverting switch 1622 | norm. | norm. |
| Potentiometer 1652 ratio | 0.046 | 0.054 |
| Potentiometer 1654 ratio | 0.90 | 0.76 |
| Potentiometer 1658 ratio | 0.77 | 0.77 |
| Inverting switch 1691 position | inv. | inv. |
| Selector switch 1685 position | 1601 | 1601 |
| Output attenuator 1686 ratio | 0.23 | 0.23 |
| Output attenuator 1687 ratio | 1.0 | 1.0 |
| Image azimuth a, degrees | −45 | −30 |
| Image altitude b, degrees | +21 | +17 |
| Image range r | remote | remote |

Note to table 3: setting of reversing switch 1659 in both cases is such that signals from element 1657 drive element 1660, and those from element 1658 drive element 1670.

Figure 19:
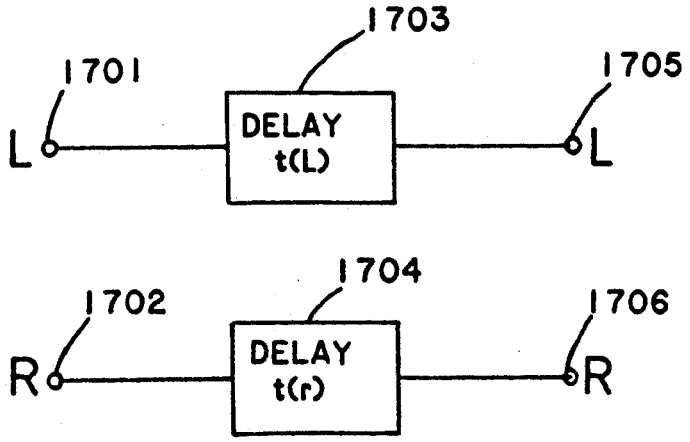
FIG. 19 is a schematic block diagram of additional circuitry which further embodies the present invention.

By addition of two extra elements to the above circuits, an extra facility for lateral shifting of the listening area is provided. It should be understood, however, that this is not essential to the creation of images. The extra elements are shown in FIG. 19, in which left and right signals 1701, 1702 may be supplied from the outputs 1688, 1689 respectively of the signal processor of FIG. 16. In each channel a delay 1703, 1704 respectively is inserted, and the output signals from the delays 1703, 1704 become the sound processor outputs 1705, 1706.

The delays introduced into the channels by this additional equipment are independent of frequency. They may thus each be completely characterized by a single real number. Let the left channel delay be t(1), and the right channel delay t(r). As in the above case, only the differential between the delays is significant, and we can completely control the equipment by specifying the difference between the delays. In implementation, we will add a fixed delay to each channel to ensure that at least no negative delay is required to achieve the required differential. Defining a differential delay t(d) as:

$$t(d)=t(r)-t(1) \tag{11}$$

If t(d) is zero, the effects produced will be essentially unaffected by the additional equipment. If t(d) is positive, the center of the listening area will be displaced laterally to the right along dimension (e) of FIG. 3. A positive value of t(d) will correspond to a positive value of (e), signifying rightward displacement. Similarly, a leftward displacement, corresponding to a negative value of (e), may be obtained by a negative value of t(d). By this method the entire listening area, in which listeners perceive the illusion, may be projected laterally to any point between or beyond the loudspeakers. It is readily possible for dimension (e) to exceed half of dimension (s), and good results have been obtained out to extreme shifts at which dimension (e) is 83% of dimension (s). This may not be the limit of the technique, but represents the limit of current experimentation.

SUMMARY OF THE INVENTION

Two ordinary, spaced-apart loudspeakers can produce a sound image that appears to the listener to be emanating from a location other than the actual location of the loudspeakers. The sound signals are processed according to this invention before they are reproduced so that no special playback equipment is required. Although two loudspeakers are required the sound produced is not the same as conventional stereophonic, left and right, sound however, stereo signals can be processed and improved according to this invention. The inventive sound processing involves dividing each monaural or single channel signal into two signals and then adjusting the differential phase and amplitude of the two channel signals on a frequency dependent basis in accordance with an empirically derived transfer function. The results of this is processing is that the apparent sound source location can be placed as desired, provided that the transfer function is properly derived. Each transfer function has an empirically derived phase and amplitude adjustment that is built-up for each predetermined frequency interval over the entire audio spectrum and provides for a separate sound source location. By providing a suitable number of different transfer functions and selecting them accordingly the sound source can appear to the listener to move. The transfer function can be implemented by analog circuit components or the monaural signal can be digitalized and digital filters and the like employed.

We claim:

1. A method for producing and locating an apparent origin of a selected sound from an input monaural signal corresponding to the selected sound in a predetermined and localized position anywhere within the three-dimensional space containing a listener, comprising the steps of:

separating said input monaural signal into respective first and second channel signals;

providing a sound position control signal derived independently of the input monaural signal for making amplitude and phase adjustments at each of a number of discrete frequency bands over the audio spectrum and relating to a sound location determined by azimuth, height, and depth;

altering the amplitude and shifting the phase of the signal in at least one of said first and second channels in response to said sound position control signal, both altering and shifting being done on a predetermined frequency dependent basis for successive discrete frequency bands across the audio spectrum and each successive phase shift being different than the preceding phase shift relative to zero degrees, thereby producing at least a first channel or a second channel modified signal and creating a continuous phase differential and a continuous amplitude differential between the two channel signals that varies for each of said discrete frequency bands;

maintaining the first channel signal separate and apart from the second channel signal following the step of altering the amplitude and shifting the phase; and respectively applying at least first and second channel modified signals that are maintained separate and apart and that have said phase and amplitude differential therebetween to first and second transducer means located with the three-dimensional space and spaced apart from the listener to produce a sound apparently originating at a predetermined location in the three dimensional space that may be different from the location of said sound transducer means.

2. The method of claim 1 further including the step of applying at least one of said first and second channel signals to at least one all pass filter, said filter having a predetermined frequency response and topology as characterized by an empirically derived transfer function T(s) for the Laplace complex frequency variable (s).

3. The method of claim 2 wherein the step of applying at least one of said signals to at least one filter includes the further step of applying said at least one signal to a cascaded series of filters.

4. The method of claim 1 further including the step of storing said first and second channel signals and modified signals derived therefrom in a medium capable of regenerating said stored signals at a subsequent selected time.

5. A system for conditioning a signal for producing and locating, using two transducers located in free space, an auditory sensory illusion of an apparent origin for at least one selected sound at a predetermined localized position located within the three-dimensional space containing a listener from a single monaural input signal corresponding to be selected sound, comprising: first and second channel means both receiving the same single monaural input signal, one of said first and signal channel means including sound processor means connected to receive a sound position control signal derived independently of the input monaural signal for controlling amplitude and phase adjustments at each of a number of selected frequency intervals of the audio spectrum and relating to a sound location determined by azimuth, height, and depth for altering the amplitude and shifting the phase angle of the respective signal on a frequency dependent basis for successive discrete frequency intervals across the audio spectrum to produce a respective modified signal therefrom in response to said sound position control signal, wherein the amplitude alterations and the phase shifts form a continuous differential between the two channels that varies for each said successive frequency interval of the audio spectrum, said sound processor means shifting the phase angle such that each phase angle shift is different relative to zero degrees, and said first and second channels being maintained separate and apart prior to being fed to the two transducers.

6. A system as in claim 5 further including storage means connected to said means for altering for storing said modified signals in a medium capable of regenerating said stored signals at a subsequent selected time.

* * * * *